US011742560B2

(12) United States Patent
Kwak

(10) Patent No.: US 11,742,560 B2
(45) Date of Patent: Aug. 29, 2023

(54) T-JUNCTION WITH HIGH ISOLATION AND METHOD FOR FABRICATING THE SAME

(71) Applicant: ELECTRONICS AND TELECOMMUNICATIONS RESEARCH INSTITUTE, Daejeon (KR)

(72) Inventor: Changsoo Kwak, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 112 days.

(21) Appl. No.: 17/126,371

(22) Filed: Dec. 18, 2020

(65) Prior Publication Data

US 2021/0194107 A1 Jun. 24, 2021

(30) Foreign Application Priority Data

Dec. 24, 2019 (KR) ..... 10-2019-0173654

(51) Int. Cl.
*H01P 5/19* (2006.01)

(52) U.S. Cl.
CPC ..... *H01P 5/19* (2013.01)

(58) Field of Classification Search
CPC ..... H01P 5/19; H01P 5/20; H01P 11/003
See application file for complete search history.

(56) References Cited

U.S. PATENT DOCUMENTS

| | | | |
|---|---|---|---|
| 7,332,982 | B2 | 2/2008 | Yun et al. |
| 10,622,714 | B2 | 4/2020 | Eom |

FOREIGN PATENT DOCUMENTS

| | | | | | |
|---|---|---|---|---|---|
| CN | 111697304 | A | * | 9/2020 | |
| CN | 113161709 | A | * | 7/2021 | ..... H01P 5/20 |
| CN | 114256585 | A | * | 3/2022 | |
| CN | 114361753 | A | * | 4/2022 | |
| KR | 10-2011-0027494 | A | | 3/2011 | |
| KR | 10-1631690 | B1 | | 6/2016 | |
| KR | 10-2016-0134381 | A | | 11/2016 | |
| KR | 10-1698125 | B1 | | 1/2017 | |
| KR | 10-2018-0056445 | A | | 5/2018 | |
| KR | 10-2019-0084964 | A | | 7/2019 | |

OTHER PUBLICATIONS

Zhengbin Xu et al., "A Novel Rectangular Waveguide T-Junction for Power Combining Application", IEEE Microwave and Wireless Components Letters, vol. 25, No. 8, Aug. 2015.

* cited by examiner

*Primary Examiner* — Hafizur Rahman
*Assistant Examiner* — Kimberly E Glenn
(74) *Attorney, Agent, or Firm* — LRK PATENT LAW FIRM

(57) ABSTRACT

A T-junction with high isolation and a method for fabricating the same are provided. The T-junction includes a power divider/combiner configured to divide or combine power, a dielectric substrate disposed perpendicular to a lower plane of the power divider/combiner, and a dielectric holder configured to dispose the dielectric substrate.

10 Claims, 19 Drawing Sheets

T-JUNCTION WITH HIGH ISOLATION AND METHOD FOR FABRICATING THE SAME

CROSS-REFERENCE TO RELATED APPLICATION(S)

This application claims the benefit of Korean Patent Application No. 10-2019-0173654, filed on Dec. 24, 2019, in the Korean Intellectual Property Office, the disclosure of which is incorporated herein by reference.

BACKGROUND

1. Field of the Invention

Example embodiments relate to a T-junction with high isolation and a method for fabricating the same.

2. Description of Related Art

A transmission array antenna requires a power divider, and a reception array antenna requires a power combiner. The power divider and the power combiner are the same in terms of shape, and are merely different from each other in terms of the return loss of respective ports or isolation requirements between the respective ports as necessary. The power divider and power combiner have a feature of radio waves thereof having directions opposite to each other. In the case of an active phased array antenna for reception, a beamforming module for controlling a phase and a magnitude of power is combined after each antenna element, followed by the power combiner. When a signal from the beamforming module is inputted to the power combiner, return loss needs to be low as well as it is necessary not to input the inputted signal back to the surrounding beamforming module. That is, isolation between respective input ports of the power combiner needs to be good.

SUMMARY

Aspects, which relate to a T-junction, provide a technology for improving isolation between individual ports while maintaining return loss of all ports by inserting a dielectric substrate on which a resistor is formed in a direction perpendicular to a plane of the power combiner/divider.

According to an aspect, there is provided a T-junction including a power divider/combiner configured to divide or combine power, a dielectric substrate disposed perpendicular to a lower plane of the power divider/combiner, and a dielectric holder configured to dispose the dielectric substrate.

The dielectric substrate may include a resistor formed on a portion of the substrate.

The dielectric holder may include a first dielectric holder and a second dielectric holder.

The first dielectric holder may include a plate, a first body positioned on a lower side of the plate to be in contact with a lower surface of the plate, the first body having a longitudinal direction, and a second body bent to extend from one side of the first body.

The first dielectric holder may include a substrate mount portion, the substrate mount portion having one surface formed to be recessed from a bent portion where the first body and the second body are connected.

The first dielectric holder may include a first stopper, the first stopper having one surface formed to protrude from the other side of the first body, and a second stopper, the second stopper having one surface formed to protrude from one side of the second body.

The second dielectric holder may include a first body having a longitudinal direction, and a second body bent to extend from one side of the first body.

The second dielectric holder may include a substrate mount portion, the substrate mount portion having one surface formed to be recessed from a bent portion where the first body and the second body are connected.

The second dielectric holder may include a first stopper insertion portion, the first stopper insertion portion having one surface formed to be recessed from the other side of the first body, and a second stopper insertion portion, the second stopper insertion portion having one surface formed to be recessed from one side of the second body.

The power divider/combiner may include a holder insertion portion positioned on an upper surface thereof, and the dielectric holder may be inserted into the holder insertion portion in a vertical direction.

According to another aspect, there is provided a dielectric holder including a plate, a substrate male holder including a first male holder body positioned on a lower side of the plate to be in contact with a lower surface of the plate, the first male holder body having a longitudinal direction, and a second male holder body bent to extend from one side of the first male holder body, and a substrate female holder including a first female holder body positioned on the lower plate of the plate to be in contact with the lower surface of the plate, the first female holder body having a longitudinal direction, and a second female holder body bent to extend from one side of the first female holder body. One surface of the male holder and one surface of the female holder may be in contact with each other, and a substrate insertion space into which a substrate is inserted may be formed therebetween.

The substrate male holder may further include a male substrate mount portion, the male substrate mount portion having one surface formed to be recessed from a bent portion where the first male holder body and the second male holder body are connected, and the substrate female holder may further include a female substrate mount portion, the female substrate mount portion having one surface formed to be recessed from a bent portion where the first female holder body and the second female holder body are connected so as to correspond to the male substrate mount portion.

The male substrate mount portion and the female substrate mount portion may fluidly communicate with each other to form a substrate insertion space.

The substrate male holder may include a first stopper, the first stopper having one surface formed to protrude from the other side of the first male holder body, and a second stopper, the second stopper having one surface formed to protrude from one side of the second male holder body. The substrate female holder may include a first stopper insertion portion, the first stopper insertion portion having one surface formed to be recessed from the other side of the first female holder body, and a second stopper insertion portion, the second stopper insertion portion having one surface formed to be recessed from one side of the second female holder body.

The first stopper and the second stopper may be respectively inserted into the first stopper insertion portion and the second stopper insertion portion.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION

Figure 1:
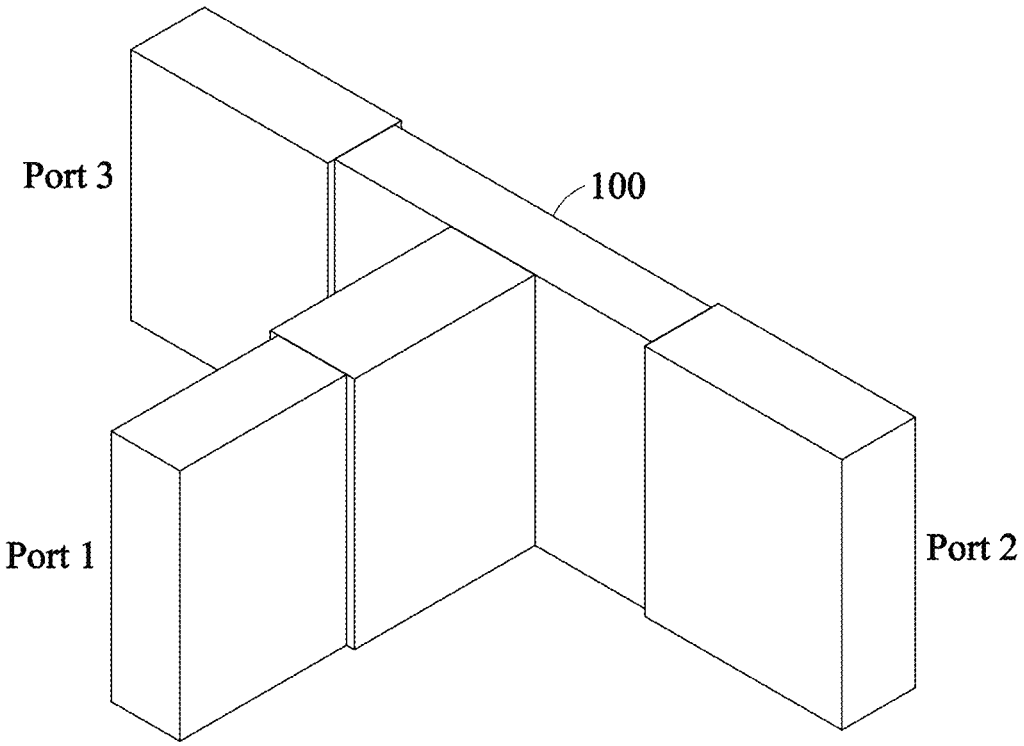
FIG. 1 is a diagram illustrating an example of a general T-junction constituting a power combiner/divider.

Hereinafter, example embodiments will be described in detail with reference to the accompanying drawings. The scope of the right, however, should not be construed as limited to the example embodiments set forth herein. Various modifications may be made to the example embodiments. Here, examples are not construed as limited to the example embodiments and should be understood to include all changes, equivalents, and replacements within the idea and the technical scope of the example embodiments.

The terminology used herein is for the purpose of describing particular example embodiments only and is not intended to be limiting. As used herein, the singular forms "a," "an," and "the," are intended to include the plural forms as well, unless the context clearly indicates otherwise. It will be further understood. that the terms "comprises," "comprising," "includes," and/or "including," when used herein, specify the presence of stated features, integers, operations, elements, and/or components, but do not preclude the presence or addition of one or more other features, integers, operations, elements, components, and/or groups thereof.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Unless otherwise defined, all terms, including technical and scientific terms, used herein have the same meaning as commonly understood by those skilled in the art to which the example embodiments pertain. Terms, such as those defined in commonly used dictionaries, are to be interpreted as having a meaning that is consistent with their meaning in the context of the relevant art, and are not to be interpreted in an idealized or overly formal sense unless expressly so defined herein.

Regarding the reference numerals assigned to the components in the drawings, it should be noted that the same components will be designated by the same reference numerals, wherever possible, even though they are shown in different drawings. Also, in the description of example embodiments, detailed description of well-known related structures or functions will be omitted when it is deemed that such description will cause ambiguous interpretation of the example embodiments.

Figure 2A:
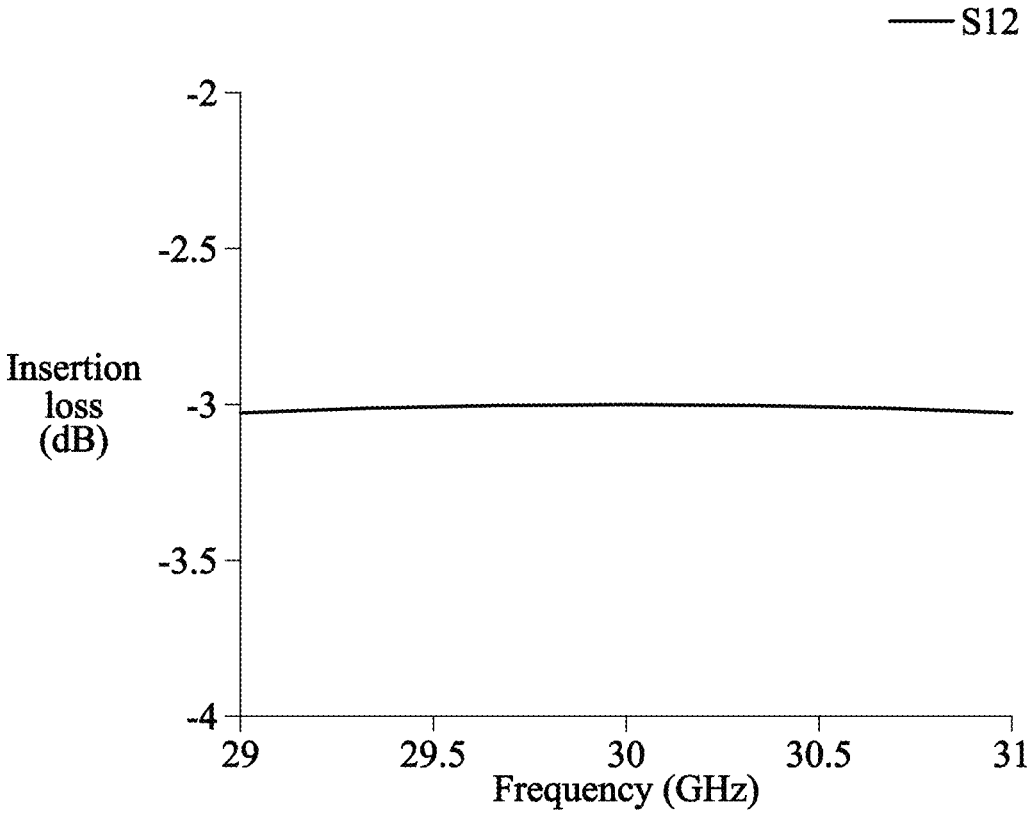
FIGS. 2A to 2C are graphs illustrating insertion loss, return loss, and isolation of the T-junction illustrated in FIG. 1.
Figure 2B:
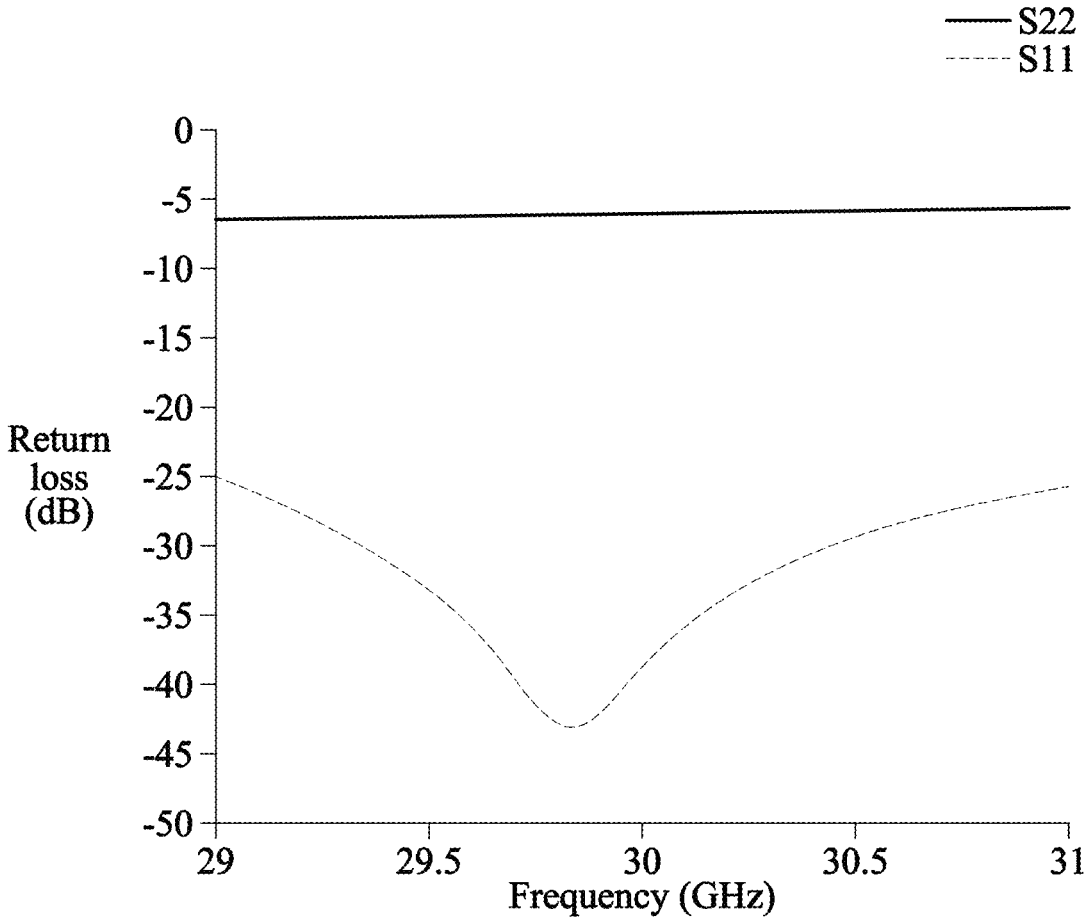
Figure 2C:
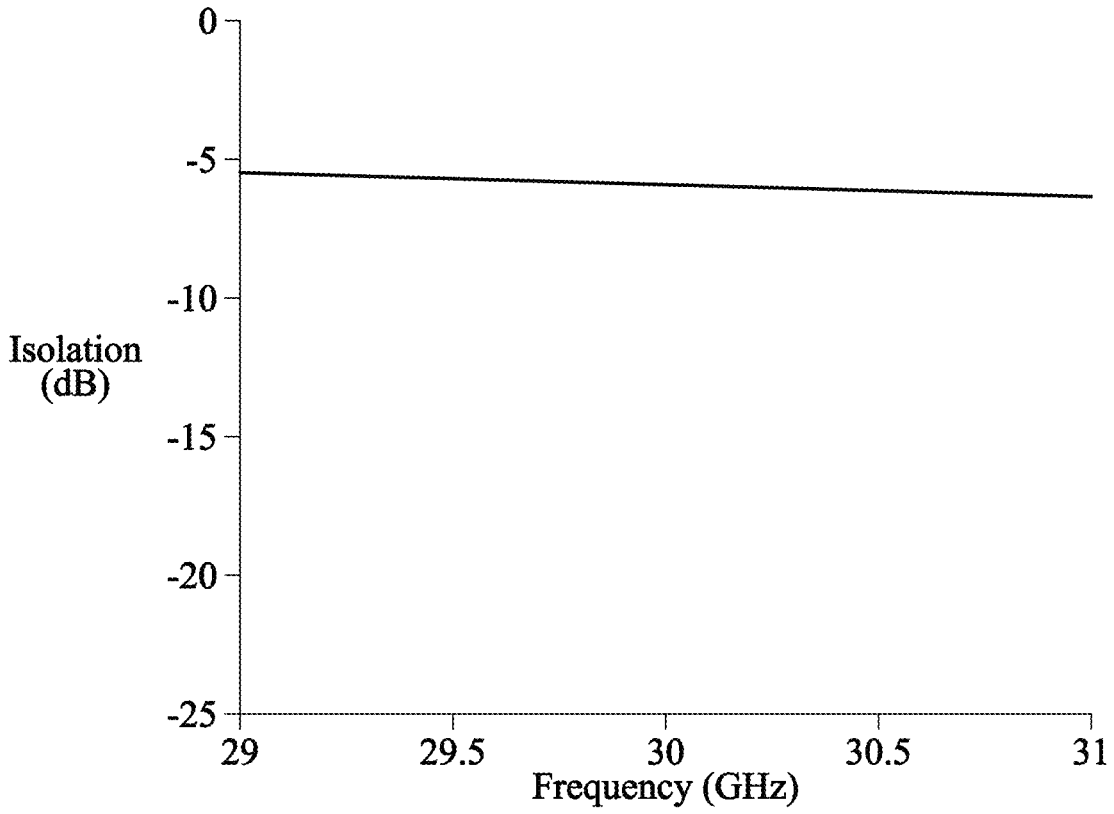

FIG. 1 is a diagram illustrating an example of a general T-junction constituting a power combiner/divider, and FIGS. 2A to 2C are graphs illustrating insertion loss, return loss, and isolation of the T-junction illustrated in FIG. 1.

A T-junction 100 may constitute a power divider or a power combiner.

The T-junction 100 may include three ports. For example, the T-junction 100 may include a first port Port 1, a second port Port 2, and a third port Port 3.

In the case of the T-junction 100 constituting the power combiner, the T-junction 100 may combine and output signals inputted to two ports to one common port. For example, signals inputted to the second port Port 2 and the third port Port3 may be combined and outputted to the first port Port 1.

In the case of the T-junction 100 constituting the power divider, the T-junction 100 may separate and output a signal inputted to one port to two different ports. For example, when a signal is inputted to the first port Port 1, signals having a same magnitude and a phase difference of 180 degrees may be outputted to the second port Port 2 and the third port Port 3.

Referring to FIG. 2C, it can be seen that ½ (−3 dB) of the signal inputted to the first port Port 1 of the T-junction 100 is outputted to the second port Port 2, and vice versa. Accordingly, a sum of signals inputted to the second port Port 2 and the third port Port 3 in the same manner may be outputted to the first port Port 1.

Referring to FIG. 2B, it can be seen that ¼ (−6 dB) of the signal inputted to the second port Port 2 of the T-junction 100 is reflected. In addition, it can be seen that a remaining ¼ (−6 dB) of the signal inputted to the second port Port 2 is outputted to the third port Port 3. Accordingly, isolation between the second port Port 2 and the third port Port 3 of the general T-junction 100 may be −6 dB.

Figure 3:
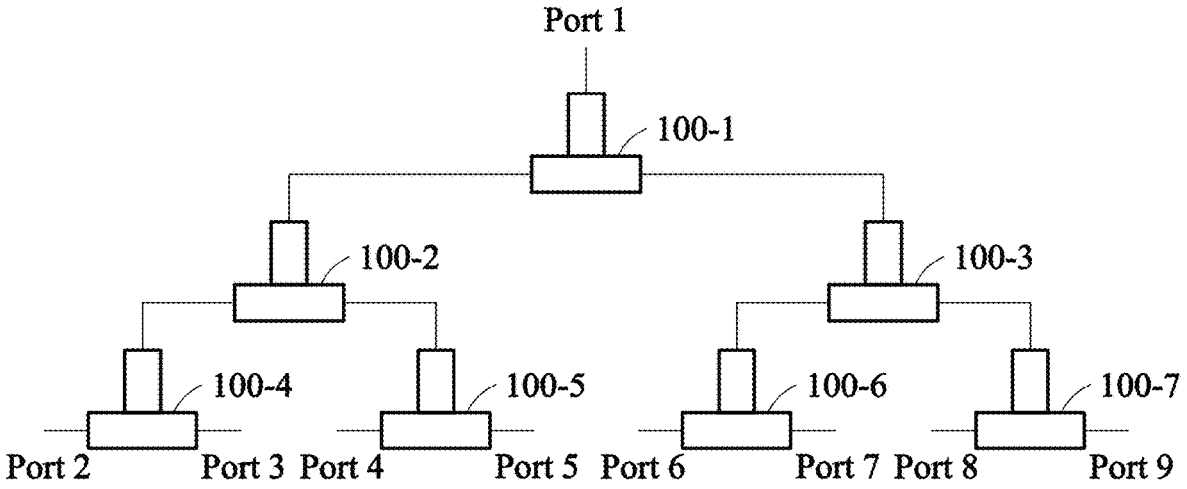
FIG. 3 is a diagram illustrating a binary power combiner implemented through the T-junction illustrated in FIG. 1.

FIG. 3 is a diagram illustrating a binary power combiner implemented through the T-junction illustrated in FIG. 1.

When one T-junction 100 is used, a 2-way combiner may be designed. In addition, when three T-junctions 100 are used, a 4-way combiner may be designed. That is, when $2^N-1$ T-junctions 100 are used, a $2^N$-way combiner may be designed.

FIG. 3 illustrates an 8-way binary combiner using seven T-junctions 100. In order for the binary combiner to have 2N input ports, 2N−1 T-junctions 100 may need to be used.

Figure 4A:
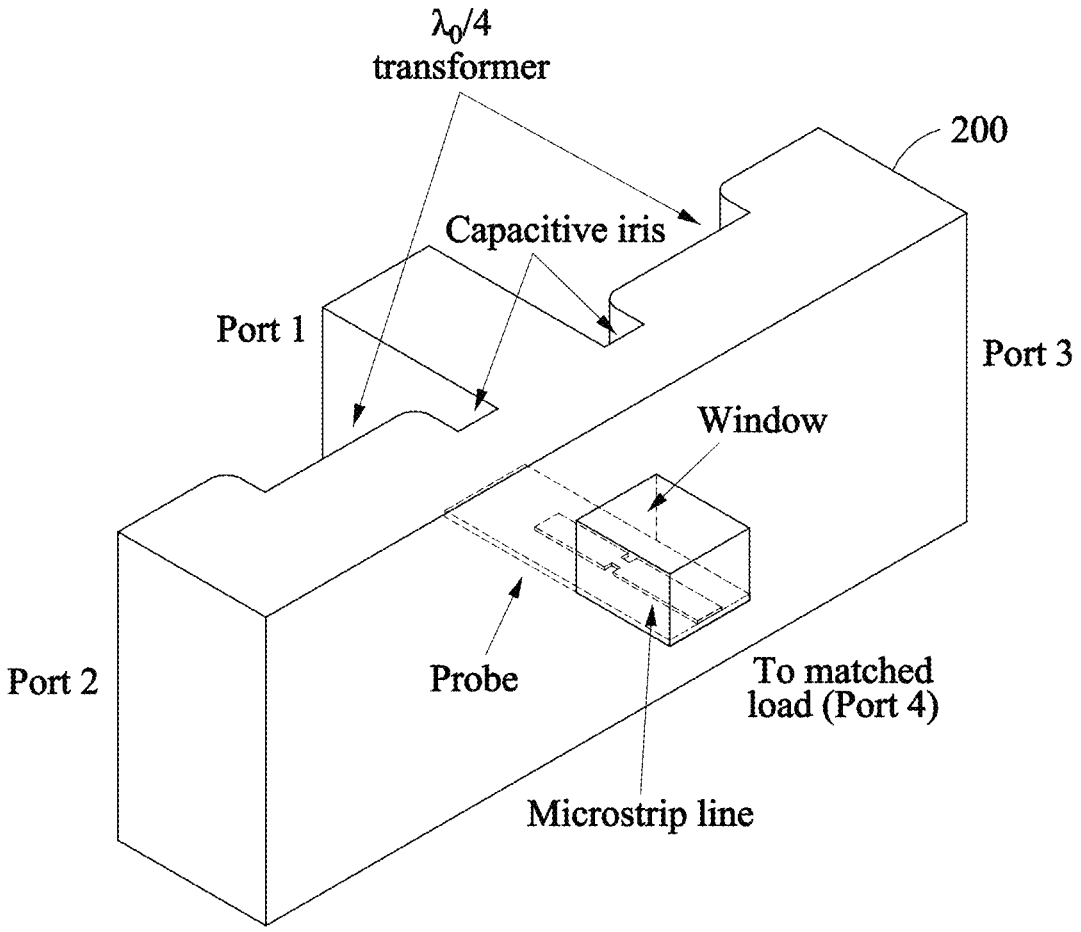
FIGS. 4A to 4C are diagrams illustrating an example of a conventional T-junction with improved isolation.
Figure 4B:
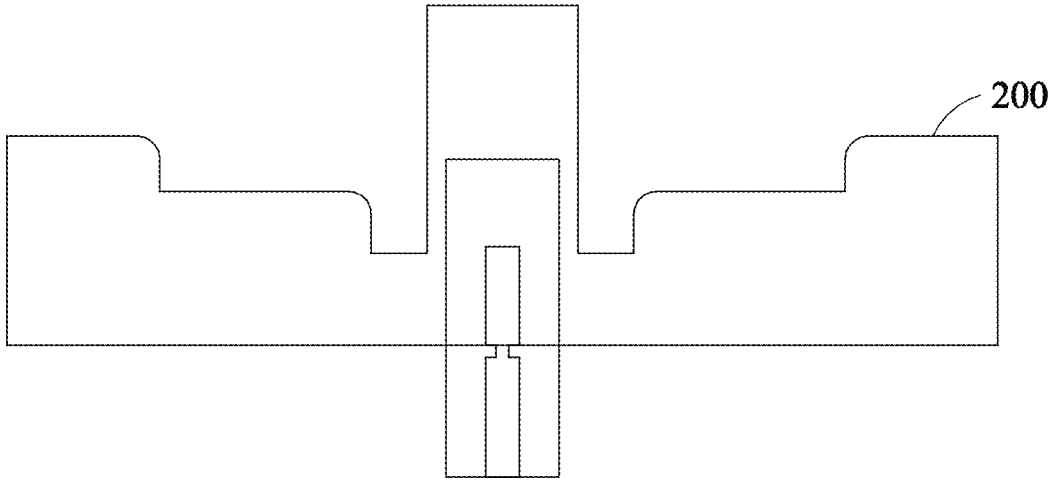
Figure 4C:
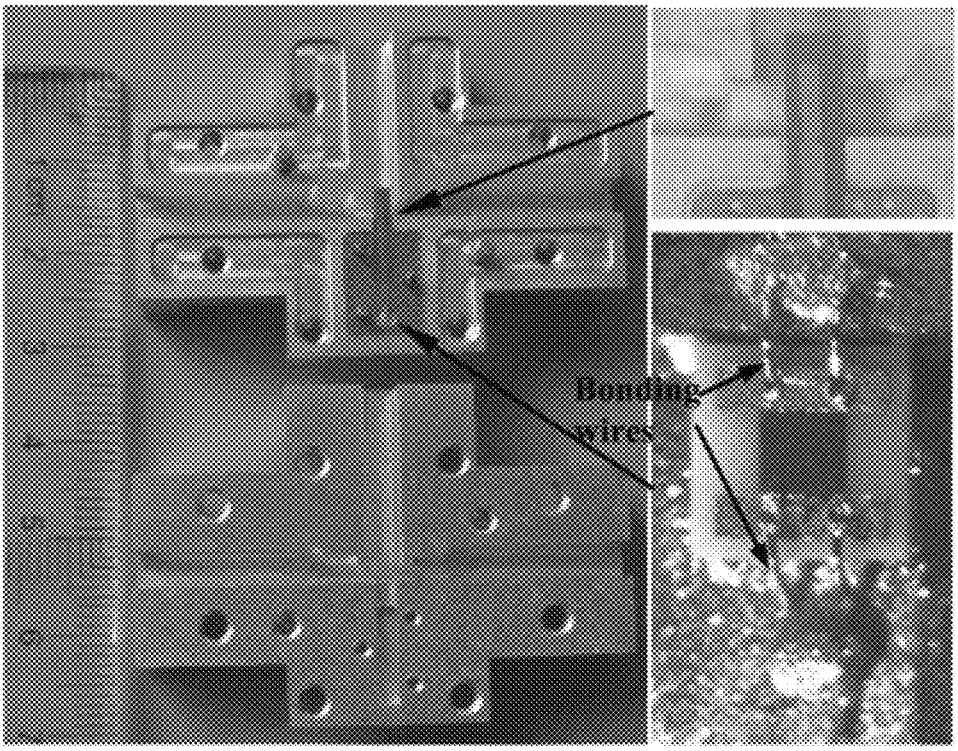

FIGS. 4A to 4C are diagrams illustrating an example of a conventional T-junction with improved isolation.

In the case of the combiner/divider illustrated in FIG. 3, the isolation between the second port Port 2 and the third port Port 3 or isolation between a fourth port Port 4 and a fifth port Port 5 may be −6 dB. The combiner/divider may generally need to have an isolation of −20 dB or less.

In order to improve the isolation, the conventional T-junction 200 may insert a microstrip line into an intersection point thereof, and may connect a matched load to the microstrip line to implement an isolation of −20 dB or less between the second port Port 2 and the third port Port 3.

The T-junction 200 may be fabricated as two parts by separating a part intermediate in a height direction of a waveguide. In one part of the T-junction 200, a dielectric substrate with the microstrip line and the load assembled at the intersection point may be fixed with silver-loaded epoxy. The T-junction 200 may be fabricated by assembling a corresponding part and a remaining part.

The T-junction 200 may require replacement of the dielectric substrate due to a fabricating error or tolerance of the microstrip line, and may have a short-coming in that workability is poor since the dielectric substrate is bonded with epoxy. In addition, the T-junction 200 may need be connected to the load by using a bonding wire, which may lead to different results for each component or for each operator, and thus it may be difficult to implement consistent performance.

Figure 5:
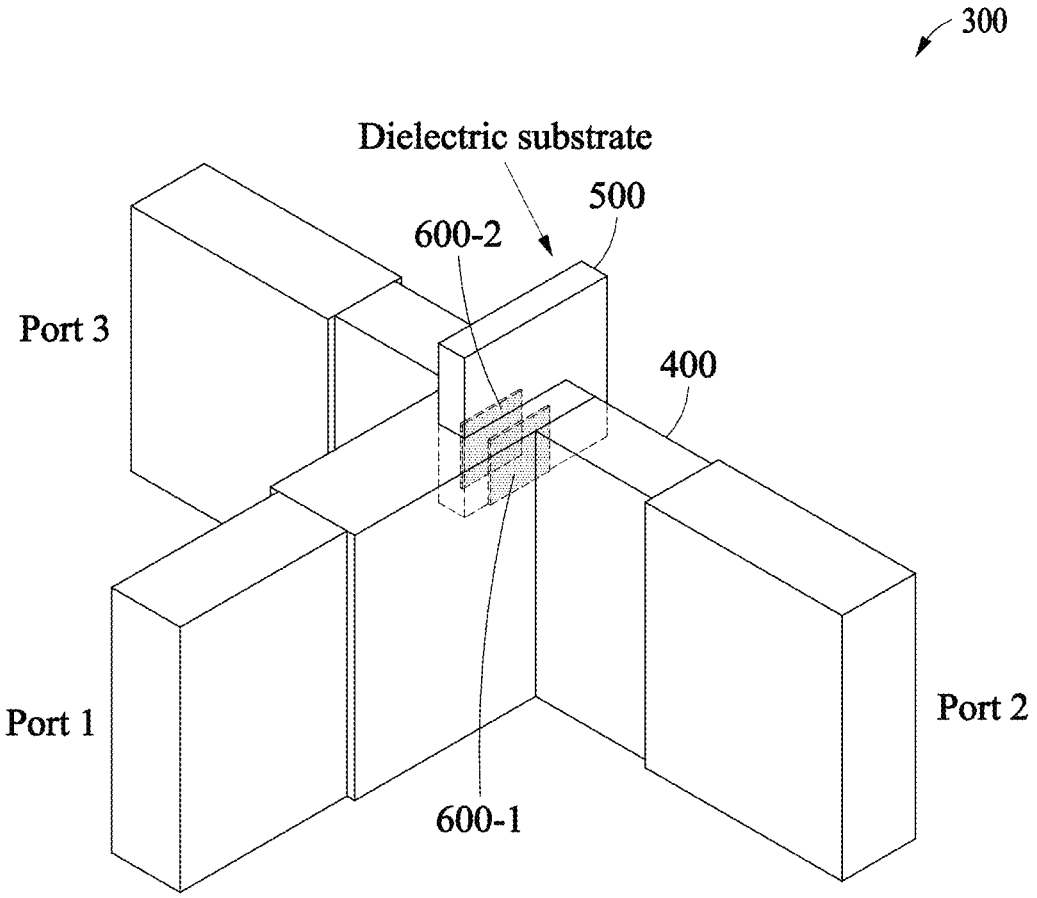
FIG. 5 is a diagram illustrating a T-junction according to an example embodiment.
Figure 6A:
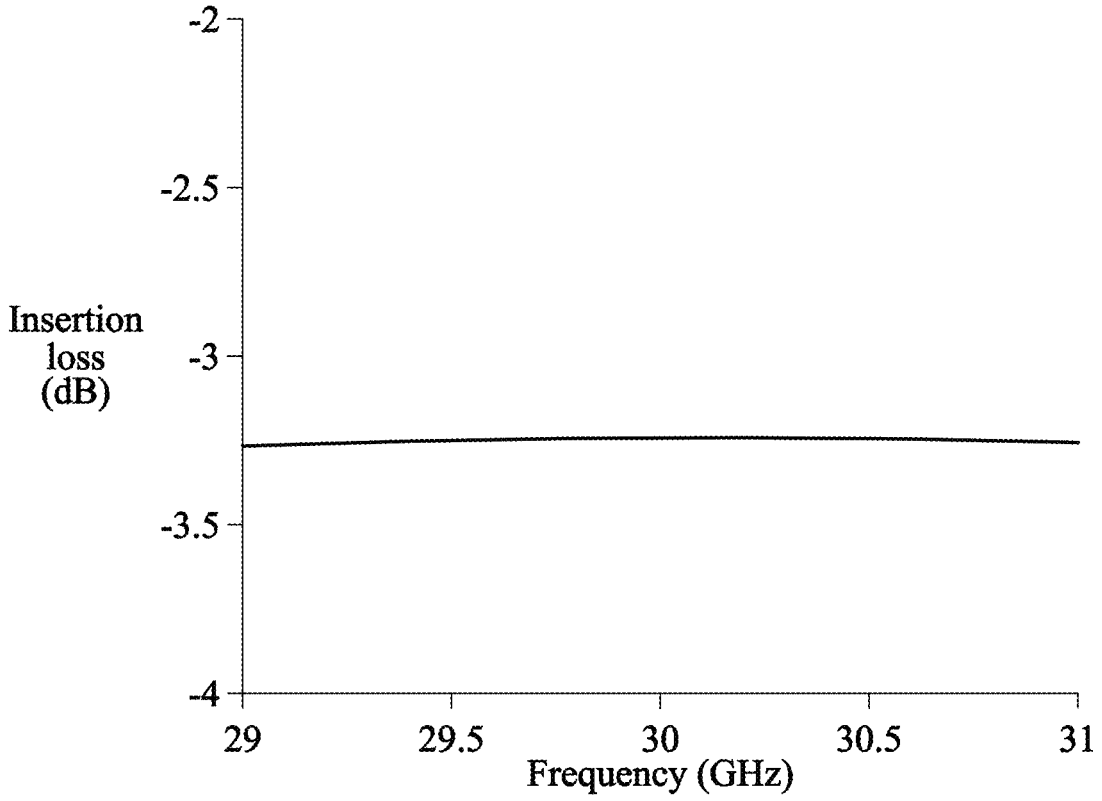
FIGS. 6A to 6C are graphs illustrating isolation of the T-junction illustrated in FIG. 5.
Figure 6B:
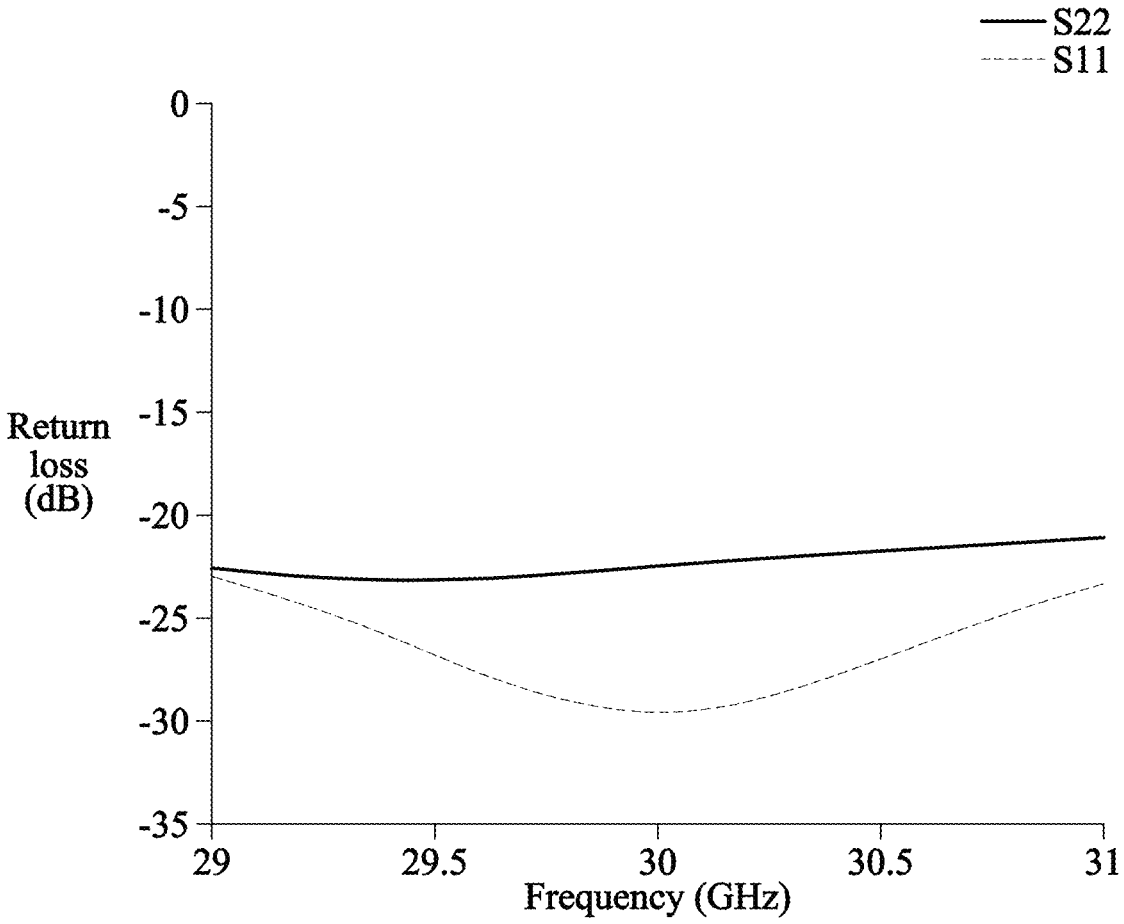
Figure 6C:
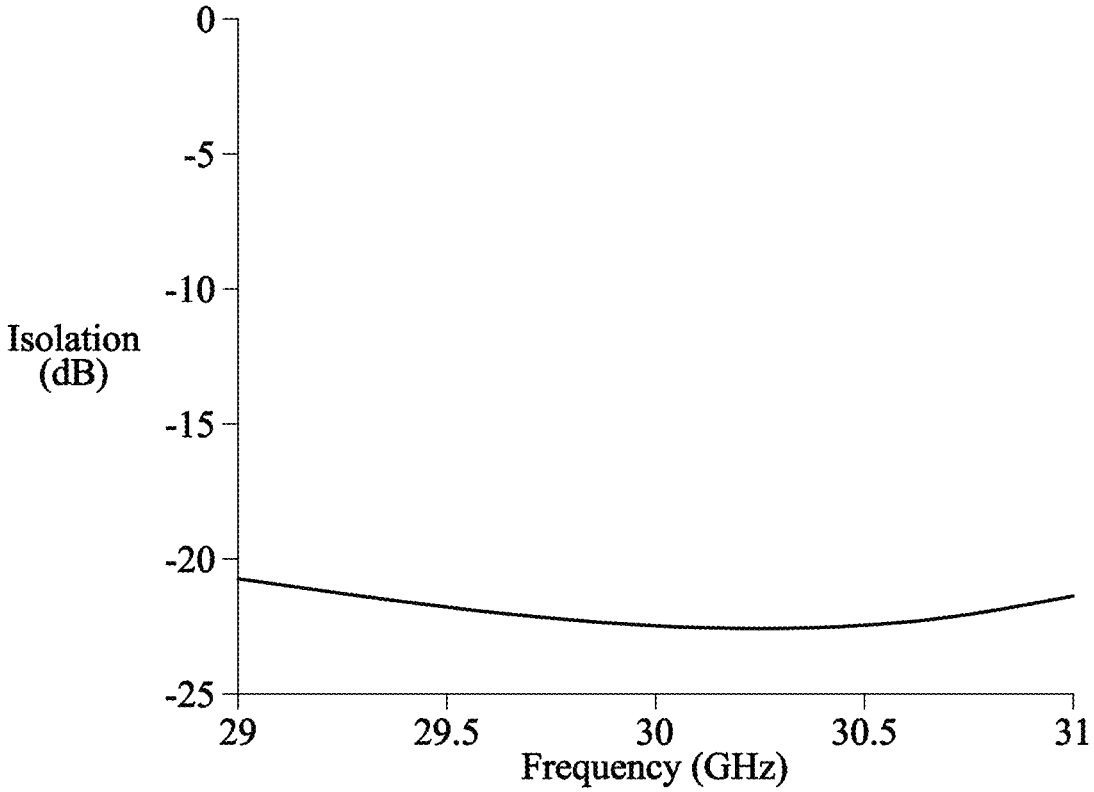

FIG. 5 is a diagram illustrating a T-junction according to an example embodiment, and FIGS. 6A to 6C are graphs illustrating isolation of the T-junction illustrated in FIG. 5.

In a T-junction 300 constituting a power combiner or power divider, a dielectric substrate 500 on which a resistor 600 is formed may be inserted in a direction perpendicular to a lower plane of the power combiner or power divider to improve isolation between two input ports or output ports.

For example, the power combiner of the T-junction 300 may improve the isolation between the two input ports, and the power divider of the T-junction 300 may improve the isolation between the two output ports.

The T-junction 300 may include a power combiner/divider 400, dielectric substrate 500, and resistors 600-1 and 600-2.

The power combiner/divider 400 may be a power combiner or a power divider depending on how to use. Hereinafter, for use of description, the power combiner/divider 400 will be collectively referred to as the combiner 400.

The combiner 400 may be implemented as a waveguide.

The resistors 600-1 and 600-2 may be thin film resistors 600-1 and 600-2. The thin film resistors 600-1 and 600-2 may be formed on the dielectric substrate 500.

The dielectric substrate 500 may be inserted in a direction perpendicular to a plane of the combiner 400. For example, the dielectric substrate 500 on which the film resistors 600-1 and 600-2 are formed may be inserted in a direction perpendicular to the plane of the combiner 400 to improve the isolation between the ports of the T-junction 300.

That is, the T-junction 300 may insert the dielectric substrate 500 including the thin film resistors 600-1 and 600-2 into an intersection point thereof to improve the isolation.

In addition, the T-junction 300 may allow the dielectric substrate 500 to be easily replaced, thereby facilitating a tuning operation required by a fabricating error or design error.

FIGS. 6A to 6C, which are examples in which the T-junction 300 is implemented in a frequency band having a center frequency of 30 GHz and a bandwidth of 2 GHz, illustrate insertion loss, return loss, and isolation, respectively.

FIG. 6A illustrates insertion losses S12 and S13 of a signal inputted to the first port Port 1 of the T-junction 300. As illustrated in FIG. 2A, the general T-junction 100 may exhibit an insertion loss of 3 dB, while the T-junction 300 may exhibit an insertion loss of 3.25 dB. A difference of 0.25 dB may be caused by the thin film resistors 600-1 and 600-2.

FIG. 6B illustrates that the first port Port 1 and the second port Port 2 have a return loss of 21 dB or more. FIG. 6B illustrates that the isolation between the second port Port 2 and the third port Port 3 is 21 dB or more. The T-junction 300 may improve the isolation by 15 dB or more in comparison to the general T-junction 100 having an isolation of 6 dB through the dielectric substrate 500 and the thin film resistors 600-1 and 600-2.

Figure 7:
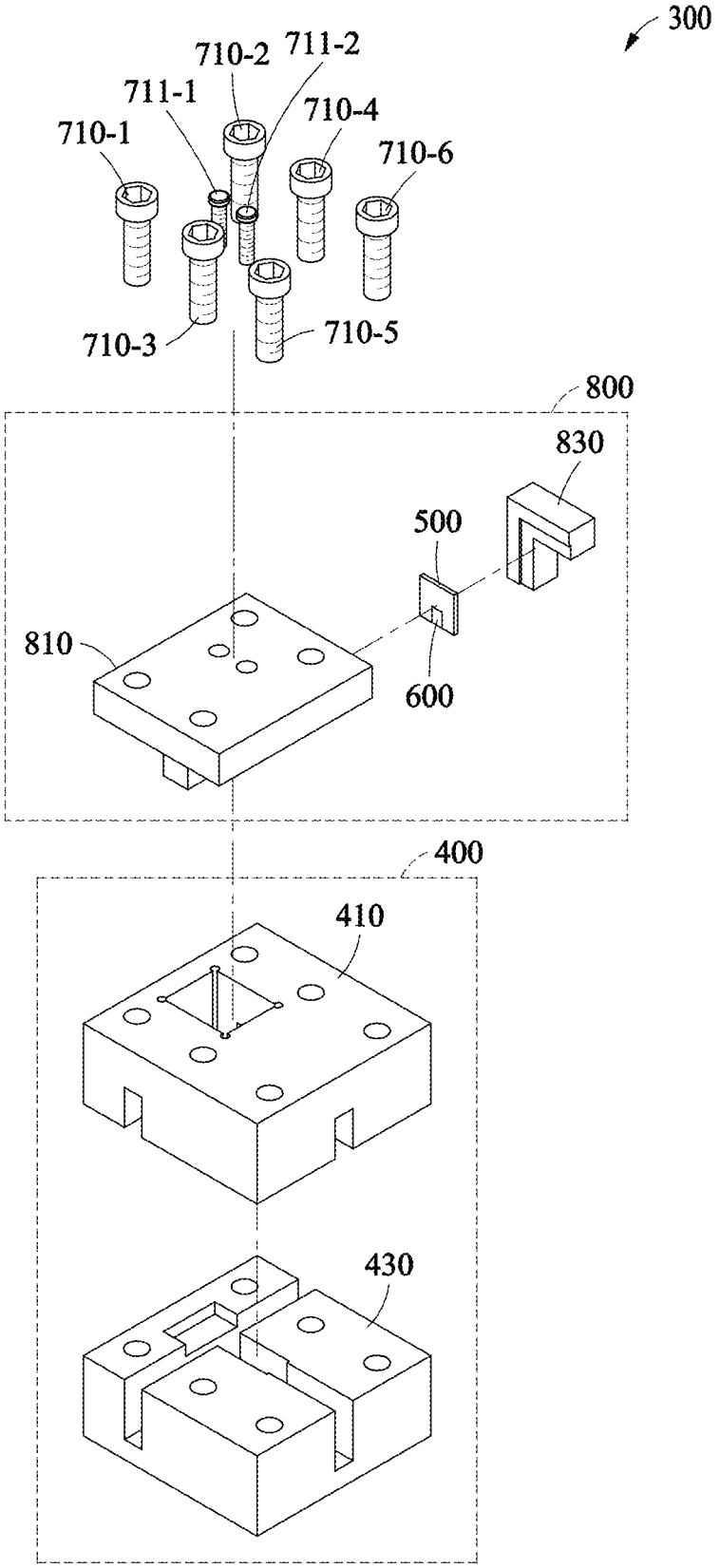
FIG. 7 is a diagram illustrating a structure of the T-junction illustrated in FIG. 5.

FIG. 7 is a diagram illustrating a structure of the T-junction illustrated in FIG. 5.

The T-junction 300 may include the combiner 400, dielectric substrate 500, dielectric holder 800, dielectric holder assembly bolts 711-1 and 711-2, and combiner assembly bolts 710-1 to 710-6.

The combiner 400 may include a combiner upper portion 410 and a combiner lower portion 430.

The resistors 600-1 and 600-2 may be formed on opposite surfaces of the dielectric substrate 500.

The dielectric holder 800 may be disposed perpendicular to the plane of the combiner 400 by fixing the dielectric substrate 500. The dielectric holder 800 may include a first dielectric holder 810 and a second dielectric holder 830.

The first dielectric holder 810 and the second dielectric holder 830 may contact the opposite surfaces of the dielectric substrate 500 to fix the dielectric substrate 500.

The first dielectric holder 810 and the second dielectric holder 830 may be assembled by the dielectric holder assembly bolts 711-1 and 711-2. FIG. 7 illustrate two dielectric holder assembly bolts 711-1 and 711-2, but the number of the dielectric holder assembly bolts is not necessarily limited thereto, and the appropriate number of the dielectric holder assembly bolts for assembling the dielectric holder 800 may be used.

The combiner assembly bolts 710-1 to 710-6 may fix the dielectric holder 800, the combiner upper portion 410, and the combiner lower portion 430. FIG. 7 illustrates six combiner assembly bolts 710-1 to 710-6, but the number of the combiner assembly bolts is necessarily limited thereto, and the appropriate number of the combiner assembly bolts for assembling the dielectric holder 800, the combiner upper portion 410, and the combiner lower portion 430 may be used.

Figure 8A:
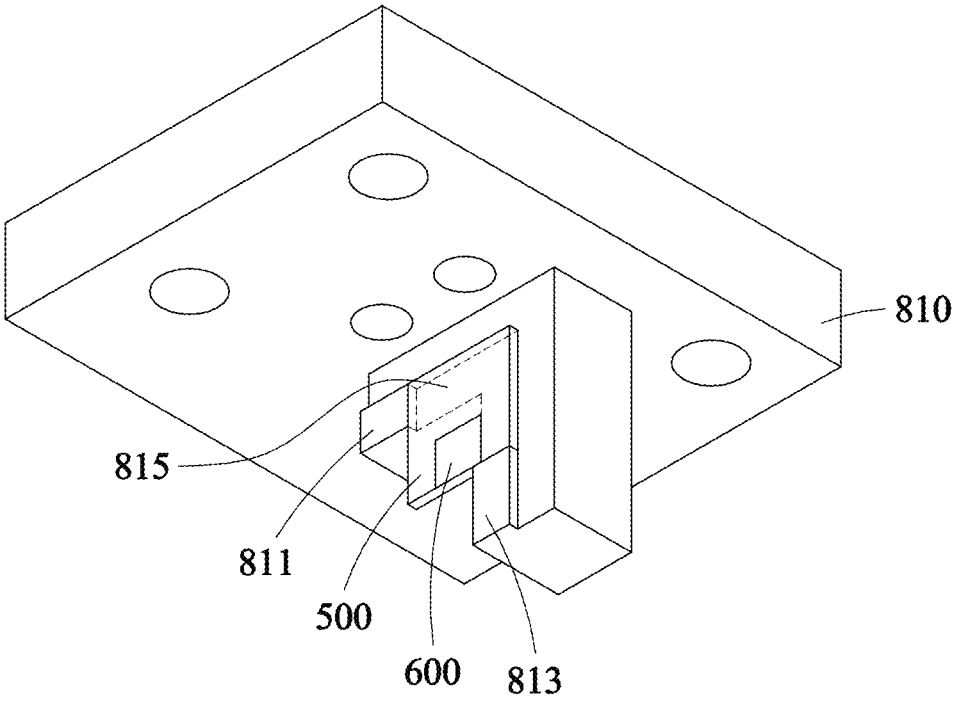
FIGS. 8A to 8C are diagrams specifically illustrating a structure of the dielectric holder illustrated in FIG. 7.
Figure 8B:
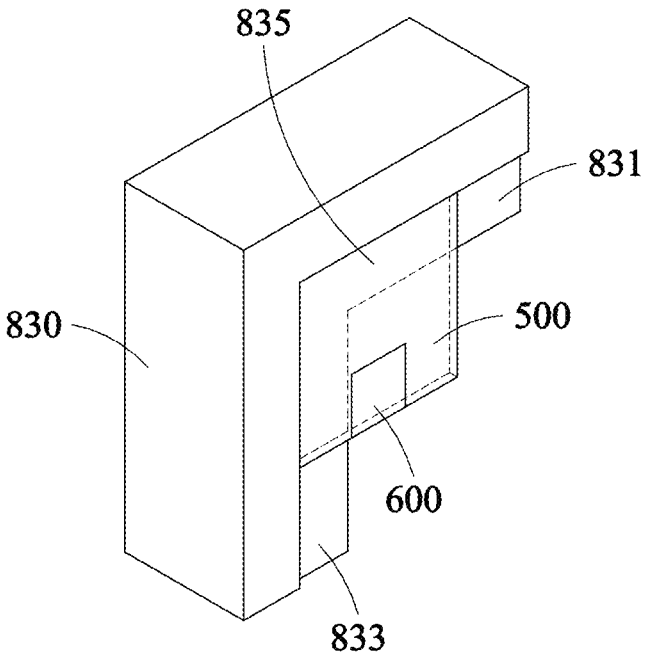
Figure 8C:
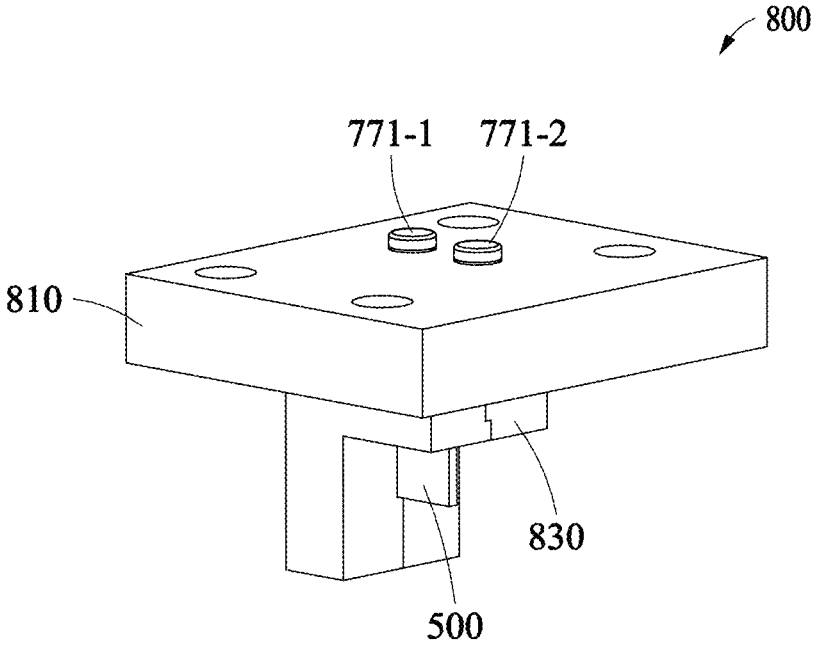

FIGS. 8A to 8C are diagrams specifically illustrating a structure of the dielectric holder illustrated in FIG. 7.

The dielectric substrate 500 may be fixed by the first dielectric holder 810 and the second dielectric holder 830. The dielectric holder 800 with the first dielectric holder 810 and the second dielectric holder 830 combined to fix the dielectric substrate 500 may be inserted into the combiner upper portion 410.

The first dielectric holder 810 may include a plate, a first body positioned on a lower side of the plate to be in contact with a lower surface of the plate, and a second body bent to extend from one side of the first body. For example, the first body may have a longitudinal direction, and may horizontally contact the lower side of the plate, and the second body may extend in a direction perpendicular to the plate.

The first dielectric holder 810 may include a substrate mount portion 815 having one surface formed to be recessed from a bent portion where the first body and the second body are connected. The dielectric substrate 500 may be inserted into the substrate mount portion 815.

The first dielectric holder 810 may include a horizontal stopper 811 having one surface formed to protrude from the other side of the first body, and a vertical stopper 813 having one surface formed to protrude from one side of the second body.

The horizontal stopper 811 and the vertical stopper 813 may fix the dielectric substrate 500 in a horizontal direction and a vertical direction, respectively.

The second dielectric holder 830 may be combined with the first dielectric holder 810 to fix the dielectric substrate 500.

The second dielectric holder 830 may include the first body having a length direction and the second body bent to extend from one side of the first body.

The second dielectric holder 830 may include a substrate mount portion 835 having one surface formed to be recessed from the bent portion where the first body and the second body are connected. The dielectric substrate 500 may be inserted into the substrate mount portion 835.

The second dielectric holder 830 may include a horizontal stopper insertion portion 831 having one surface formed to be recessed from the other side of the first body, and a vertical stopper insertion portion 833 having one surface formed to be recessed from one side of the second body.

When the first dielectric holder 810 and the second dielectric holder 830 are combined, the horizontal stopper 811 and the vertical stopper 813 may be inserted into the horizontal stopper insertion portion 831 and the vertical stopper insertion portion 833, respectively.

The first dielectric holder 810 and the second dielectric holder 830 may be fixed by the dielectric holder assembly bolts 711-1 and 711-2.

Figure 9:
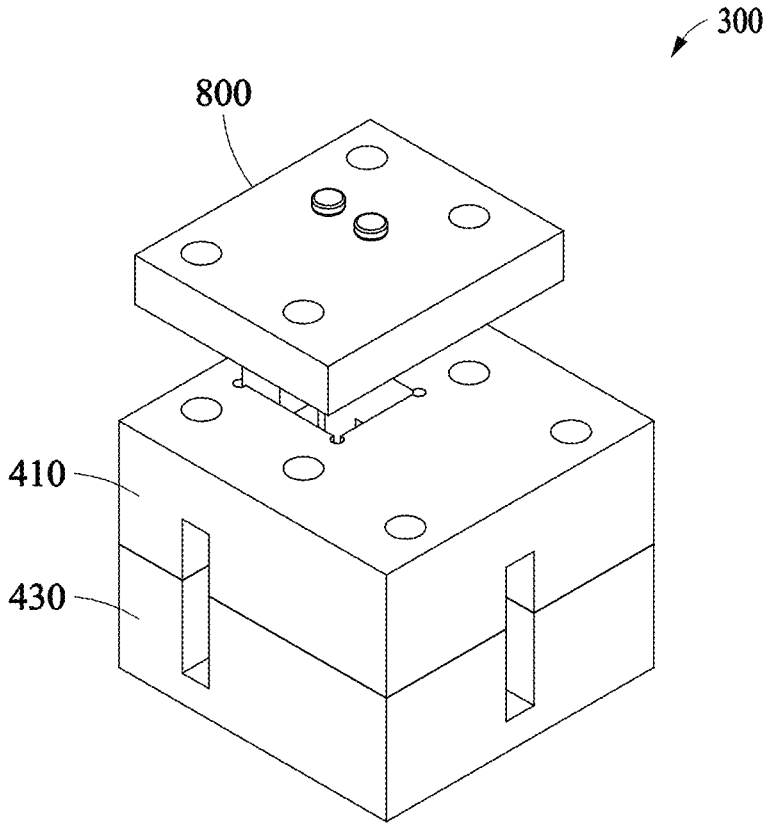
FIG. 9 is a diagram illustrating a method for assembling the dielectric holder and the combiner illustrated in FIG. 7.
Figure 10:
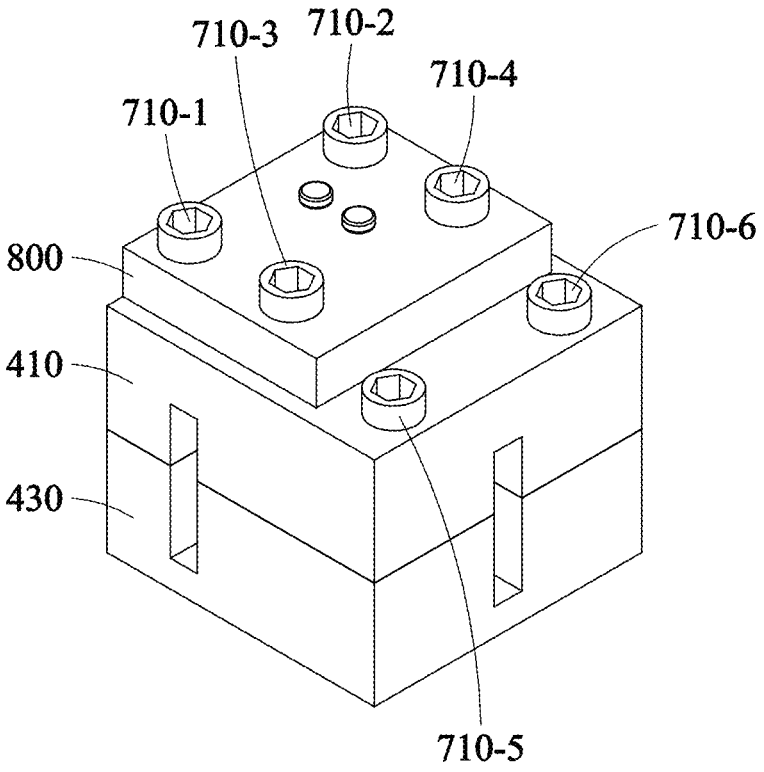
FIG. 10 is a diagram illustrating an assembled shape of the T-junction illustrated in FIG. 7.

FIG. 9 is a diagram illustrating a method for assembling the dielectric holder and the combiner illustrated in FIG. 7, and FIG. 10 is a diagram illustrating the T-junction illustrated in FIG. 7.

The dielectric holder 800 may be inserted into the combiner upper portion 410 in a vertical direction. For example, a portion of the dielectric holder 800 other than the plate may be inserted into a hole formed in the combiner upper portion 410. That is, the dielectric holder 800 may be inserted into the combiner upper portion 410 in a vertical direction and fixed by the plate of the first dielectric holder 810.

The dielectric substrate 500 fixed by the dielectric holder 800 may be inserted in a direction perpendicular to the plane of the combiner 400. For example, the dielectric substrate 500 on which the film resistors 600-1 and 600-2 are formed may be inserted in a direction perpendicular to the plane of the combiner 400 to improve the isolation between the ports of the T-shaped junction 300.

A resistance element may be inserted into the intersection point of the T-junction 300, and thus the isolation between the ports may be 20 dB or more.

In addition, the dielectric substrate 500 may be easily replaced by using the dielectric holder 800, thereby facilitating a tuning operation required by a fabricating error or design error of the T-junction 300.

That is, since the dielectric substrate 500 on which the resistor 600 is implemented is designed as a separate module (for example, the dielectric holder 800), the dielectric substrate 500 may be easily assembled into the combiner 400, and thus the T-junction 300 may easily replace the resistor 600. In addition, when an error is found in a magnitude or resistance value of the resistor 600 after assembly, the error may be easily corrected.

The T-junction 300 may be implemented even when a gap between waveguides constituting the combiner 400 is narrow since the dielectric substrate 500 on which the resistor 600 is implemented is inserted in a direction perpendicular to the plane of the combiner 400.

Figure 11:
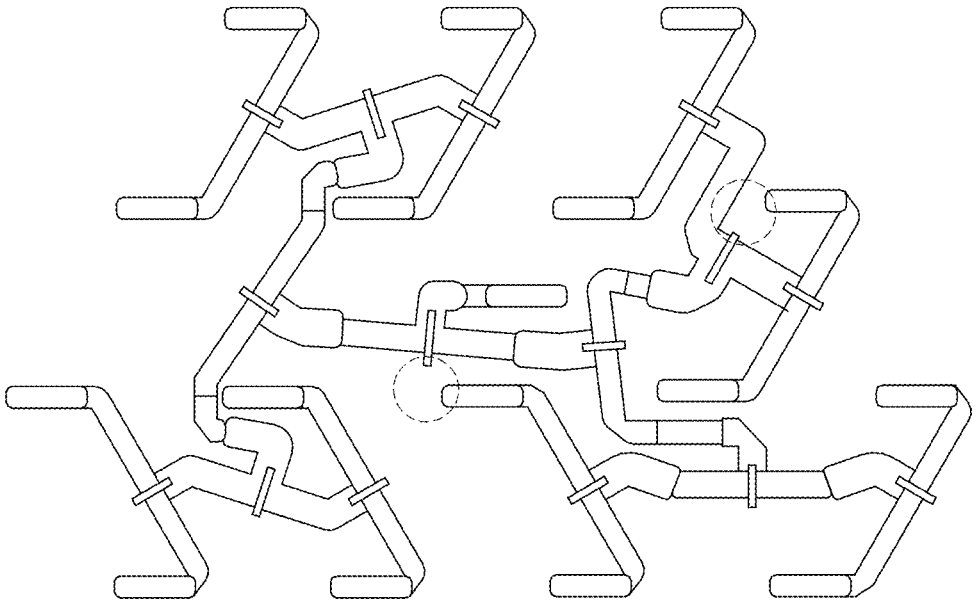
FIG. 11 is a diagram illustrating a power combiner/divider implemented through the T-junction illustrated in FIG. 7.

FIG. 11 is a diagram illustrating a power combiner/divider implemented through the T-junction illustrated in FIG. 7.

A portion indicated by a broken line in FIG. 11 is too close to other portions of a waveguide, and thus interference may occur when the dielectric substrate 500 is inserted into the plane. However, when the dielectric substrate 500 is vertically inserted, such a problem may not occur.

The components described in the example embodiments may be implemented by hardware components including, for example, at least one digital signal processor (DSP), a processor, a controller, an application-specific integrated circuit (ASIC), a programmable logic element, such as a field programmable gate array (FPGA), other electronic devices, or combinations thereof. At least some of the functions or the processes described in the example embodiments may be implemented by software, and the software may be recorded on a recording medium. The components, the functions, and the processes described in the example embodiments may be implemented by a combination of hardware and software.

Although the example embodiments have been described with reference to the limited drawings as described above, various modifications and changes may be made from the foregoing descriptions by those skilled in the art. For example, suitable results can be achieved even if the described techniques are performed in a different order, and/or even if components of the described system, structure, device, circuit, and the like are coupled or combined in a different manner, or are replaced or substituted by other components or their equivalents.

Therefore, other implementations, other example embodiments, and equivalents to the claims are also within the scope of the following claims.

What is claimed is:

1. A T-junction comprising:

a power divider/combiner configured to divide or combine power;

a dielectric substrate disposed perpendicular to a T-shaped plane of the power divider/combiner; and a dielectric holder configured to dispose the dielectric substrate.

2. The T-junction of claim 1, wherein the dielectric substrate comprises a resistor formed on a portion of the substrate.

3. The T-junction of claim 1, wherein the dielectric holder comprises a first dielectric holder and a second dielectric holder.

4. The T-junction of claim 3, wherein the first dielectric holder comprises:

a plate;

a first body positioned on a lower side of the plate to be in contact with a lower surface of the plate, the first body having a longitudinal direction; and a second body bent to extend from one side of the first body.

5. The T-junction of claim 4, wherein the first dielectric holder comprises a substrate mount portion, the substrate mount portion having one surface formed to be recessed from a bent portion where the first body and the second body are connected.

6. The T-junction of claim 4, wherein the first dielectric holder comprises:

a first stopper, the first stopper having one surface formed to protrude from the other side of the first body; and a second stopper, the second stopper having one surface formed to protrude from one side of the second body.

7. The T-junction of claim 3, wherein the second dielectric holder comprises:

a first body having a longitudinal direction; and a second body bent to extend from one side of the first body.

8. The T-junction of claim 7, wherein the second dielectric holder comprises a substrate mount portion, the substrate mount portion having one surface formed to be recessed from a bent portion where the first body and the second body are connected.

9. The T-junction of claim 7, wherein the second dielectric holder comprises:

a first stopper insertion portion, the first stopper insertion portion having one surface formed to be recessed from the other side of the first body; and a second stopper insertion portion, the second stopper insertion portion having one surface formed to be recessed from one side of the second body.

10. The T-junction of claim 1, wherein:

the power divider/combiner comprises a holder insertion portion positioned on an upper surface thereof, and the dielectric holder is inserted into the holder insertion portion in a vertical direction.

* * * * *